US009713925B2

(12) United States Patent
Nakamura

(10) Patent No.: US 9,713,925 B2
(45) Date of Patent: Jul. 25, 2017

(54) PRINTER, INK SUPPLY DEVICE AND PRINTING METHOD

(71) Applicant: MIMAKI ENGINEERING CO., LTD., Nagano (JP)

(72) Inventor: Tohru Nakamura, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/058,306

(22) Filed: Oct. 21, 2013

(65) Prior Publication Data

US 2014/0111585 A1 Apr. 24, 2014

(30) Foreign Application Priority Data

Oct. 23, 2012 (JP) ..... 2012-233476

(51) Int. Cl.
*B41J 2/19* (2006.01)
*B41J 2/175* (2006.01)
*B41J 2/18* (2006.01)

(52) U.S. Cl.
CPC ..... *B41J 2/19* (2013.01); *B41J 2/175* (2013.01); *B41J 2/18* (2013.01)

(58) Field of Classification Search
CPC . B41J 2/175; B41J 2/18; B41J 2/17596; B41J 2/19; B41J 2/17509; B41J 2/17556; B41J 2/17513; B41J 2/17523; B41J 2202/07
USPC ..... 347/6, 7, 65, 84, 89, 92
See application file for complete search history.

(56) References Cited

U.S. PATENT DOCUMENTS 1,938,522 A * 12/1933 Grayson ..... 62/270
2,548,003 A * 4/1951 Davidson ..... 95/259
2,792,904 A * 5/1957 Sebald ..... 96/198
3,421,622 A * 1/1969 Wurtmann ..... 209/731
3,460,319 A * 8/1969 Tkach ..... 95/9
4,350,503 A * 9/1982 Skoli et al. ..... 96/162
4,392,874 A * 7/1983 Yamauchi ..... 96/200
4,502,055 A * 2/1985 Horike et al. ..... 347/92
(Continued)

FOREIGN PATENT DOCUMENTS

CN 1485209 3/2004
EP 1243310 A2 * 9/2002
(Continued)

OTHER PUBLICATIONS

Machine Translation for JP 2008-237979 A.*
(Continued)

*Primary Examiner* — Jannelle M Lebron
(74) *Attorney, Agent, or Firm* — Jianq Chyun IP Office

(57) ABSTRACT

To properly perform deaeration of ink in an ink-jet printer. An ink supply portion includes an ink tank, a deaeration portion, an upstream-side ink flow path and a downstream side ink flow path, in which the deaeration portion includes an ink branching portion, plural deaeration modules arranged in parallel in an ink flow path, plural pumps, and an ink converging portion. Respective plural deaeration modules are arranged between the ink branching portion and the ink converging portion in corresponding branch flow paths, and respective pumps are arranged in series to corresponding deaeration modules in the branch flow paths, allowing ink to flow in corresponding deaeration modules.

8 Claims, 5 Drawing Sheets

(56) References Cited

U.S. PATENT DOCUMENTS

| | | | | |
|---|---|---|---|---|
| 4,602,923 | A * | 7/1986 | Bernstein | 96/172 |
| 4,937,598 | A | 6/1990 | Hine et al. | |
| 4,961,082 | A * | 10/1990 | Hoisington et al. | 347/92 |
| 6,059,405 | A * | 5/2000 | Mochizuki et al. | 347/92 |
| 6,109,037 | A * | 8/2000 | Kumagai et al. | 60/677 |
| 6,126,151 | A * | 10/2000 | Vodicka | 261/136 |
| 6,224,201 | B1 | 5/2001 | Shigemura | |
| 6,447,679 | B1 * | 9/2002 | Watari et al. | 210/500.23 |
| 7,011,387 | B2 * | 3/2006 | Saito et al. | 347/29 |
| 2007/0263244 | A1 * | 11/2007 | Sugitani | B41J 3/543 358/1.15 |
| 2008/0049084 | A1 * | 2/2008 | Katada | 347/92 |
| 2008/0238980 | A1 * | 10/2008 | Nagashima et al. | 347/17 |
| 2009/0040249 | A1 * | 2/2009 | Wouters et al. | 347/7 |
| 2010/0186777 | A1 * | 7/2010 | Nakahara et al. | 134/30 |
| 2010/0247769 | A1 * | 9/2010 | Ooishi et al. | 427/256 |

FOREIGN PATENT DOCUMENTS

| | | | |
|---|---|---|---|
| JP | 55132264 | A * | 10/1980 |
| JP | 05-17712 | | 1/1993 |
| JP | 11-42771 | | 2/1999 |
| JP | 11042795 | A * | 2/1999 |
| JP | H1142795 | | 2/1999 |
| JP | 2005059476 | A * | 3/2005 |
| JP | 2006231809 | | 9/2006 |
| JP | 2006297902 | A * | 11/2006 |
| JP | 2008237979 | A * | 10/2008 |
| JP | 2011255643 | | 12/2011 |
| WO | 2004106068 | | 12/2004 |
| WO | 2011/136079 | | 11/2011 |

OTHER PUBLICATIONS

"Office Action of Chinese Counterpart Application", issued on Feb. 2, 2015, with English translation thereof, pp. 1-26, in which one of the listed references (CN1485209) was cited.

"Office Action of Chinese Counterpart Application", issued on Sep. 30, 2015, with English translation thereof, pp. 1-13.

"Extended European Search Report of European Counterpart Application", issued on Feb. 27, 2014, pp. 1-8, in which three of the listed references (U.S. Pat. No. 6,224,201, U.S. Pat. No. 4,937,598, WO2011/136079) were cited.

"Office Action of European Counterpart Application", issued on Jun. 18, 2015, pp. 1-5.

"Office Action of Japan Counterpart Application" with English translation, issued on May 10, 2016, pp. 1-8, in which the listed references were cited.

* cited by examiner

PRINTER, INK SUPPLY DEVICE AND PRINTING METHOD

CROSS-REFERENCE TO RELATED APPLICATIONS

This application claims the priority benefit of Japan application serial no. 2012-233476, filed on Oct. 23, 2012. The entirety of the above-mentioned patent application is hereby incorporated by reference herein and made a part of this specification.

BACKGROUND

Technical Field

The present disclosure relates to a printer, an ink supply device and a printing method.

Description of the Background Art

In recent years, an inkjet printer performing a printing by discharging ink drops is widely used. However, in the inkjet printer, when a gas is dissolved in the ink, the gas may grow into bubbles, for example, in a process of discharging the ink drops from an inkjet head. Moreover, an ink-discharge failure such as non-discharge of the ink or a so-called flying curve may occur, which affects accuracy of the printing. Accordingly, it is required to remove dissolved gas in the ink which is supplied to the inkjet head for stably discharging ink drops.

In response to the above, a structure in which a deaerator is provided in an ink flow path toward an inkjet head to remove dissolved gas in the ink is known from the past. For example, in JP-A-11-42771 (Patent Document 1), an inkjet recording apparatus having the above structure in which the deaerator is provided in an ink-supply flow path is disclosed. Also, in JP-A-5-17712 (Patent Document 2), there is disclosed a method of removing dissolved gas in an ink by allowing the gas to permeate to the outside through a membrane having gas permeability, which is the method of perform deaeration by connecting two or more deaeration elements in one deaerator for performing deaeration processing satisfying a certain standard.

[Patent Document 1] JP-A-11-42771

[Patent Document 2] JP-A-5-17712

SUMMARY

It can be considered that a function of performing deaeration in the inkjet printer is realized by, for example, an exchangeable module (deaeration module) and so on. Accordingly, the inventors of the present application have begun with the investigation of various structures of arranging the deaeration module. Then, the inventors of the present application have found in the investigation that there is a case where it is preferable that plural deaeration modules are arranged in parallel, and have keenly studied the structure.

However, as a result of further performing various investigation by actually fabricating a prototype, it has been found that a discharge liquid does not flow in plural deaeration modules uniformly and flows only in part of the deaeration modules nonuniformly, when the deaeration modules are merely arranged in parallel. They also have found a problem that variation in the flow rate of ink flowing in respective deaeration modules is increased beyond expectation. When variation in the flow rate of ink flowing in respective deaeration modules is increased, the deaeration volume intended at the time of design may be difficult to be obtained, even when the designed flow rate can be secured as the whole flow rate of ink. When there is a difference in the flow rate of ink flowing in respective deaeration modules, a difference also occurs in periods when respective deaeration modules should be exchanged, which increases trouble in management. In the case where all deaeration modules are exchanged in the same exchange period, the frequency of exchanging deaeration modules is increased, which drastically increases costs.

Moreover, for example, in an inkjet printer using ink of plural colors, plural deaeration modules are respectively arranged in ink flow paths of respective colors in parallel. Then, when variation occurs in the flow rate of the plural deaeration modules in the ink flow paths of respective colors, variation may occur also in deaeration volume of ink of respective colors. Accordingly, it may be more difficult to properly control the deaeration volume of ink.

Accordingly, it has been desired to arrange the deaeration modules by a more preferable structure compared with the conventional art. In view of the above, the present disclosure provides a printer, an ink supply device and a printing method capable of solving the above problems.

When performing deaeration of ink, the necessary deaeration volume variously differs according to the structure of the inkjet printer or types of ink. Accordingly, in the inkjet printer, it is desirable to use the deaeration moludes in a structure that the ability of deaeration can be changed so as to correspond to types of ink and so on. And, in order to properly perform deaeration at lower cost, it is desirable to properly perform deaeration, for example, by using fewer types of deaeration modules (preferably general-purpose inexpensive deaeration modules), not using many types of deaeration modules.

In response to the above, when the structure in which plural deaeration modules are arranged in parallel is applied, the deaeration volume can be adjusted easily as well as adequately by, for example, changing the number of deaeration modules to be used in accordance with the necessary deaeration volume. Accordingly, it may be preferable to apply the structure in which plural deaeration modules are arranged in parallel from the above point of view.

Additionally, there may be a case where the deaeration module is necessary to be installed at a position apart from the inkjet head on the structure of the inkjet printer. There also may be a case where an ink flow path (a tube and the like) from the deaeration module to the inkjet head is extended accordingly.

For example, in the case where the deaeration module is arranged in the middle of the flow path through which ink is sent from an ink tank to the inkjet head in a large-sized inkjet printer using the ink tank, there may be a case where the ink flow path from the deaeration module to the inkjet head is extended. Additionally, for example, in a case of a flat-bed type inkjet printer having a flat bed on which a printed matter is placed, a long ink flow path will be necessary for scanning the inkjet head on all over the flat bed.

In response to the above, the inventors of the present application have found by keen investigation that durability may be insufficient in the structure where such long ink flow path is necessary, because the load on the ink flow path and a pump for allowing ink to flow in the deaeration module is increased as the resistance of the ink flow path is increased. The structure in which plural deaeration modules are arranged in parallel is preferable also for solving the above problem.

In order to solve the above problems, the present disclosure includes the following structures.

(Structure 1) A printer, performing a printing in an inkjet system, the printer includes: an inkjet head for discharging ink drops; and an ink supply portion for supplying ink to the inkjet head. The ink supply portion includes: an ink tank for storing ink; a deaeration portion for deaerating gas dissolved in ink which is in an ink flow path from the ink tank to the ink jet head; an upstream-side ink flow path which is an ink flow path on the upstream side of the deaeration portion, sending ink supplied from the ink tank to the deaeration portion; and a downstream-side ink flow path which is an ink flow path on the downstream side of the deaeration portion, sending ink after passing through the deaeration portion to the inkjet head. the deaeration portion includes: an ink branching portion for splitting ink supplied from the upstream-side ink flow path between plural branch flow paths; plural deaeration modules which are modules for deaerating gas dissolved in ink, in which one or more modules are arranged in respective plural branch flow paths, thereby being arranged in parallel in the ink flow path; plural pumps arranged so as to correspond to plural deaeration modules; and an ink converging portion for converging the plural branch flow paths to send ink to the downstream-side ink flow path. And, each of the plural deaeration modules is arranged between the ink branching portion and the ink converging portion in a corresponding branch flow path, and each of the plural pumps is arranged in series to a corresponding deaeration module in each of the branch flow paths, allowing ink to flow into the corresponding deaeration module.

When configured as the above, the flow rate of the ink flowing in respective deaeration modules arranged in parallel can be suitably set by the pumps corresponding to the deaeration modules. Accordingly, for example, the flow rate of ink flowing in respective deaeration modules arranged in parallel can be suitably uniformed. Additionally, the intended deaeration volume can be suitably obtained in the structure in which plural deaeration modules are arranged in parallel. Moreover, in periods when respective deaeration modules should be exchanged, the increases of trouble in management can be properly prevented. Therefore, when the above structure is applied, the deaeration of ink can be performed more suitably by the structure in which plural deaeration modules are arranged in parallel.

(Structure 2) The pumps may be arranged on the downstream side of the deaeration modules in respective branch flow paths in the ink flow path.

The inventors of the present application have found by keen investigation that the load applied on the deaeration modules becomes too high and the deaeration modules may be damaged when the pumps are arranged on the upstream side of the deaeration modules in the ink flow path. For example, the ink flow path from the deaeration modules to the inkjet head is long, the resistance in the flow path is increased, and ink may hardly flow on the downstream side of the deaeration modules. Then, when the pumps such as tube pumps keep sending a fixed amount of ink to the deaeration modules in the above case, the load applied on the deaeration modules becomes too high, as a result, the deaeration modules may be blown out.

In respond to this, when the pumps are arranged on the downstream side of the deaeration modules in the ink flow path, the above excessive load is not applied on the deaeration modules. Therefore, for example, the deaeration of ink can be performed more suitably according to the above structure.

(Structure 3) The ink supply portion may include: plural ink tanks, plural deaeration portions corresponding to the plural ink tanks, plural upstream-side ink flow paths corresponding to the plural deaeration portions, and plural downstream-side ink flow paths corresponding to the plural deaeration portions. And, each deaeration portion may include: the ink branching portion, the plural deaeration modules, the plural pumps, and the ink converging portion.

Respective plural ink tanks are, for example, ink tanks for each-color ink to be used for printing, respectively storing ink of different colors. When the above structure is applied, for example, respective ink can be properly deaerated in the case where plural types of ink are used.

(Structure 4) The pumps may be tube pumps for sending ink by rollers bearing down the tubes, the deaeration portion may further include an actuator for driving the rollers in the pumps, and the rollers of the plural pumps arranged on the plural branch flow paths branched from one upstream-side ink flow path may be driven by one actuator.

When the above structure is applied, for example, the flow rate of liquid sent by respective pumps can be uniformed more suitably. Moreover, the flow rate of ink flowing in respective deaeration modules arranged in parallel can be uniformed more properly according to the above structure. Furthermore, as it is sufficient that one actuator such as a motor is used with respect to plural pumps, costs of the device can be also reduced.

(Structure 5) The rollers of the plural pumps arranged on the plural branch flow paths branched from the upstream-side ink path may be configured so that the roller of one pump is operated in conjunction with the roller of the other pump, and the actuator may allow the roller of one pump to be operated in conjunction with the roller of the other pump by driving the roller of the other pump.

When the above structure is applied, plural pumps can be properly driven by one actuator. Moreover, the flow rate of ink flowing in respective deaeration modules arranged in parallel can be uniformed more properly according to the above structure.

(Structure 6) A printer, performing a printing in an inkjet system, the printer includes: an inkjet head for discharging ink drops; and an ink supply portion for supplying ink to the inkjet head. The ink supply portion includes: an ink tank for storing ink, and a deaeration portion for deaerating gas dissolved in ink which is in an ink flow path from the ink tank to the ink jet head. The deaeration portion includes: deaeration modules for deaerating gas dissolved in ink, and pumps for allowing ink to flow into the deaeration modules. The pumps are arranged on the downstream side of the deaeration modules in the ink flow path.

When the above structure is applied, for example, it is possible to properly prevent the excessive load from being applied on the deaeration modules. Moreover, the deaeration of ink can be performed more properly according to the structure.

(Structure 7) The printer may be a flat-bed type inkjet printer, and the deaeration portion may be installed apart from the inkjet head at a fixed position in the printer.

In the flat-bed type inkjet printer, for example, the ink flow path for sending ink to the inkjet head is particularly extended. Accordingly, when the pumps are arranged on the upstream side of the deaeration modules in the ink flow path, the load applied on the deaeration modules is liable to be increased. In response to this, the deaeration of ink can be performed more properly according to the structure also in the flat-bed type inkjet printer.

(Structure 8) The ink supply portion may further include: a downstream-side ink flow path which is an ink flow path on the downstream side of the deaeration portion, sending ink after passing through the deaeration portion to the inkjet head, and the downstream-side ink flow path may be an ink flow path having a tube of a length of 5 m or more. It is preferable that the downstream-side flow path has a tube of for example, a length of 8 m or more (for example, approximately 8 to 9 m).

In the case where the downstream-side flow path is long as described above, when the pumps are arranged on the upstream side of the deaeration modules in the ink flow path, the load applied on the deaeration modules is liable to be increased. In response to this, the deaeration of ink can be performed more properly according to the structure also when the downstream-side ink flow path is long.

(Structure 9) An ink supply device, supplying ink to an inkjet head which discharges ink drops in a printer, and the printer performing a printing in an ink jet system, the ink supply device includes: an ink tank for storing ink; a deaeration portion for deaerating gas dissolved in ink which is in an ink flow path from the ink tank to the ink jet head; an upstream-side ink flow path which is an ink flow path on the upstream side of the deaeration portion, sending ink supplied from the ink tank to the deaeration portion; and a downstream-side ink flow path which is an ink flow path on the downstream side of the deaeration portion, sending ink after passing through the deaeration portion to the inkjet head. The deaeration portion includes: an ink branching portion for splitting ink supplied from the upstream-side ink flow path between plural branch flow paths; plural deaeration modules which are modules for deaerating gas dissolved in ink, in which one or more modules are arranged in respective plural branch flow paths, thereby being arranged in parallel in the ink flow path; plural pumps arranged so as to correspond to plural deaeration modules; and an ink converging portion for converging the plural branch flow paths to send ink to the downstream-side ink flow path. And, each of the plural deaeration modules is arranged between the ink branching portion and the ink converging portion in a corresponding branch flow path, and each of the plural pumps is arranged in series to a corresponding deaeration module in each of the branch flow paths, allowing ink to flow into the corresponding deaeration module. When the above structure is applied, for example, the same advantage as the structure 1 can be obtained.

(Structure 10) A printing method, performing a printing in an ink jet system, the printing method is performed by using an ink supply device which supplies ink to an inkjet head for discharging ink drops. The printing method includes: storing ink by an ink tank; deaerating gas dissolved in ink which is in an ink flow path from the ink tank to the ink jet head by a deaeration portion; sending ink supplied from the ink tank to the deaeration portion by an upstream-side ink flow path which is an ink flow path on the upstream side of the deaeration portion; and sending ink after passing through the deaeration portion to the inkjet head by a downstream-side ink flow path which is an ink flow path on the downstream side of the deaeration portion. The deaeration portion includes: an ink branching portion for splitting ink supplied from the upstream-side ink flow path between plural branch flow paths; plural deaeration modules which are modules for deaerating gas dissolved in ink, in which one or more modules are arranged in respective plural branch flow paths, thereby being arranged in parallel in the ink flow path; plural pumps arranged so as to correspond to plural deaeration modules; and an ink converging portion for converging the plural branch flow paths to send ink to the downstream-side ink flow path. And, each of the plural deaeration modules is arranged between the ink branching portion and the ink converging portion in a corresponding branch flow path, and each of the plural pumps is arranged in series to a corresponding deaeration module in each of the branch flow paths, allowing ink to flow into the corresponding deaeration module. When the above structure is applied, for example, the same advantage as the structure 1 can be obtained.

(Structure 11) An ink supply device, supplying ink to an inkjet head which discharges ink drops in a printer, the printer performing a printing in an ink jet system, the ink supply device includes: an ink tank for storing ink; and a deaeration portion for deaerating gas dissolved in ink which is in an ink flow path from the ink tank to the ink jet head. The deaeration portion includes: deaeration modules for deaerating gas dissolved in ink; and pumps for allowing ink to flow into the deaeration modules. And, the pumps are arranged on the downstream side of the deaeration modules in the ink flow path. When the above structure is applied, for example, the same advantage as the structure 6 can be obtained.

(Structure 12) A printing method, performing a printing in an ink jet system, the printing method is performed by using an ink supply device which supplies ink to an inkjet head for discharging ink drops. The printing method includes: storing ink by an ink tank, and deaerating gas dissolved in ink which is in an ink flow path from the ink tank to the ink jet head by a deaeration portion. The deaeration portion includes: deaeration modules for deaerating gas dissolved in ink, and pumps for allowing ink to flow into the deaeration modules. And, the pumps are arranged on the downstream side of the deaeration modules in the ink flow path. When the above structure is applied, for example, the same advantage as the structure 6 can be obtained.

According to the disclosure, the deaeration of ink can be performed more properly in the inkjet printer.

BRIEF DESCRIPTION OF THE DRAWINGS

FIG. 1A shows an example of a structure of the inkjet printer. FIG. 1B shows an example of a structure of an ink supply portion;

FIGS. 5A and 5B are perspective views showing an example of specific structures of the pumps and the pump drive motor. FIGS. 5C and 5D are perspective views showing a structure for interlocking the pumps with each other.

DESCRIPTION OF EXEMPLARY EMBODIMENTS

Figure 1A:
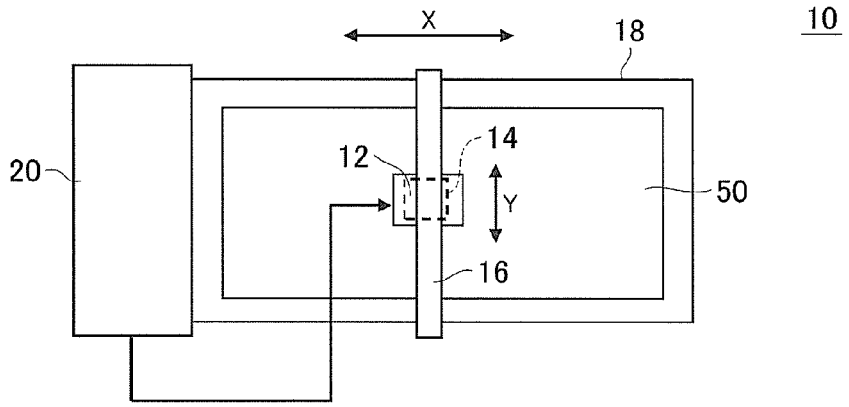
FIGS. 1A and 1B are views showing an example of an inkjet printer according to an embodiment of the present disclosure.
Figure 1B:
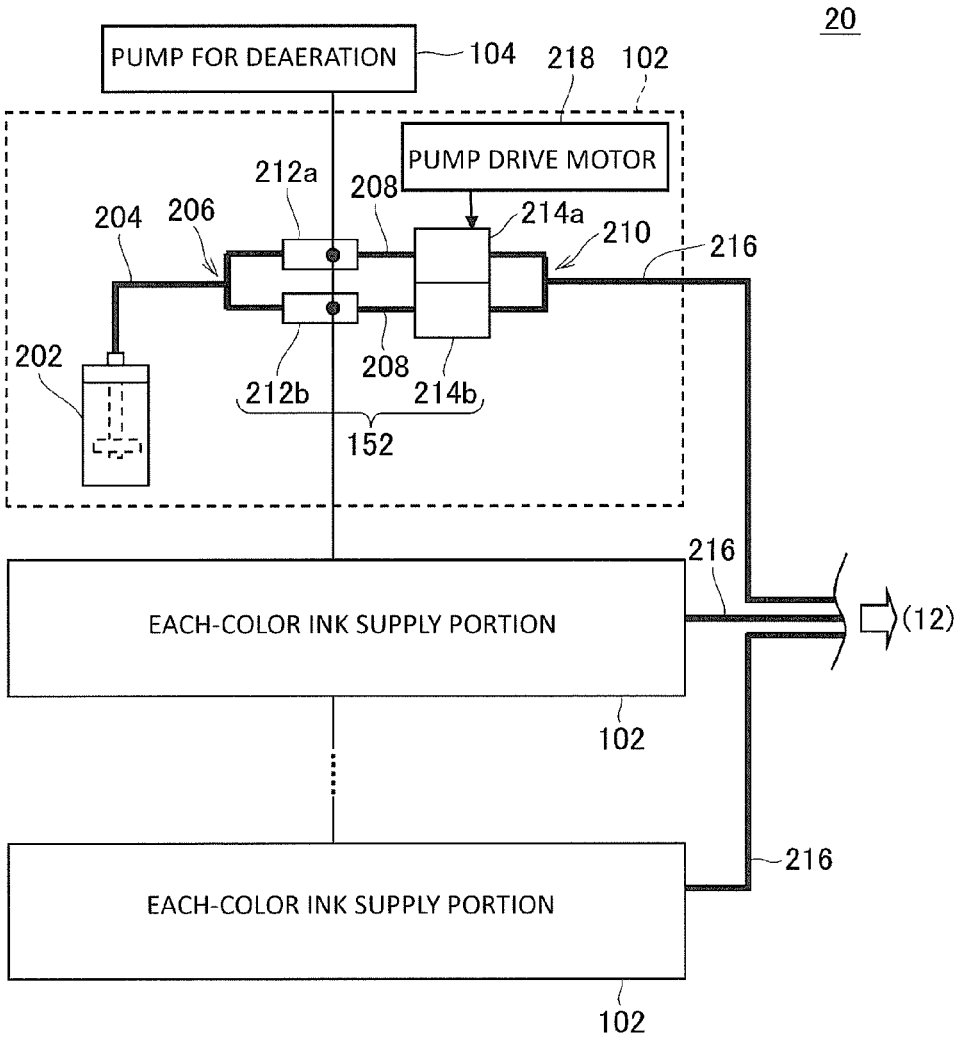

Hereinafter, an embodiment of the present disclosure will be explained with reference to the drawings. FIGS. 1A and 1B show an example of an inkjet printer 10 according to an embodiment of the disclosure. FIG. 1A shows an example of a structure of the inkjet printer 10. In the present embodiment, the inkjet printer 10 is a flat-bed type inkjet printer, including: an inkjet head 12, a carriage 14, a guide rail 16, a pedestal portion 18 and an ink supply portion 20.

The inkjet head 12 is a printing head for discharging ink drops to a medium 50 (i.e., an object to be printed). The carriage 14 is member of holding the inkjet head 12 and travels in a given Y-direction (scanning direction) along the guide rail 16 in a state of holding the inkjet head 12, thereby allowing the inkjet head 12 to perform a main scanning operation (scanning operation). The guide rail 16 is a rail member for holding the carriage 14 so as to be travelable. In the embodiment, the guide rail 16 relatively moves the ink-jet head 12 with respect to the medium 50 by moving in the X-direction orthogonal to the Y-direction. The carriage 14 and the guide rail 16 allow the inkjet head 12 to discharge ink drops at respective positions on the medium 50 by the above operation. According to the embodiment, printing can be properly performed at respective positions on the medium 50.

In a modification example of the structure of the inkjet printer 10, it can be also considered that a position of the guide rail 16 in the X-direction is fixed, and the medium 50 is carried in the X-direction. Also in this case, printing can be properly performed at respective positions on the medium 50.

The pedestal portion 18 is a pedestal for holding the medium 50 to be placed on an upper surface thereof, and the pedestal portion 18 forms a support body of the inkjet printer 10 with the ink supply portion 20 by being set in a state of connecting to the ink supply portion 20. In the embodiment, the pedestal portion 18 supports the guide rail 16 so as to be movable in the X-direction.

The ink supply portion 20 is a component for supplying ink to the inkjet head 12. In the embodiment, the ink supply portion 20 is arranged at a fixed position in the inkjet printer 10 so as to be apart from the inkjet head 12, and the ink supply portion 20 is connected to the inkjet head 12 through an ink flow path such as a tube and the like. Then, the ink supply portion 20 supplies ink to the inkjet head 12 through the ink flow path.

FIG. 1B shows an example of a structure of the ink supply portion 20. In the embodiment, the ink supply portion 20 includes: a pump for deaeration 104 and plural each-color ink supply portion 102. The pump for deaeration 104 is a pump for exhausting gas from the deaerator modules arranged in respective each-color ink supply portions 102. In the embodiment, the pump for deaeration 104 is provided in common to plural each-color ink supply portions 102, and one pump for deaeration 104 exhausts gas from the deaeration modules of plural each-color ink supply portions 102.

The each-color ink supply portions 102 are components for supplying ink of respective colors to be used in the inkjet printer 10. In the embodiment, the each-color ink supply portion 102 includes: an ink tank 202, an upstream-side ink flow path 204, a deaeration portion 152 and a downstream-side ink flow path 216.

The each-color ink supply portion 102 can further include a valve for controlling the flow of ink in the middle of the ink flow path, though not shown. In the embodiment, respective each-color ink supply portions 102 have the same structure other than the type (color) of ink to be supplied. In a modification example of the structure of the ink-supply portion 20, the structure of a part of respective each-color ink supply portions 102 is made to be different from other respective each-color ink supply portions 102, for example, according to characteristics of ink. The each-color ink supply portions 102 may supply various types of discharge liquid other than ink.

The ink tank 202 is a tank for storing ink used in printing. The ink tank 202 supplies ink to the inkjet head 12 through the upstream-side ink flow path 204, the deaeration portion 152 and the downstream-side ink flow path 216. In the embodiment, the ink tank 202 in the each-color ink supply portion 102 respectively store ink of one color in plural types (colors) of ink used for printing. The ink tank 202 has a function of agitating the stored ink for keeping liquidity of the ink inside the tank.

The upstream-side ink flow path 204 is an upstream side flow path with respect to the deaeration portion 152 in the ink flow path, and the ink supplied from the ink tank 202 is sent to the deaeration portion 152. As the upstream-side ink flow path 204, for example, a tube and the like for sending ink can be suitably used.

The deaeration portion 152 is a component for deaerating gas dissolved in ink in the ink flow path from the ink tank 202 to the inkjet head 12. In the embodiment, as the deaeration portion 152 is arranged inside the ink supply portion 20, the deaeration portion 152 is arranged apart from the inkjet head 12 at a fixed position in the inkjet printer 10. Also, in the embodiment, the deaeration portion 152 includes: an ink branching portion 206, plural branch flow paths 208, plural deaeration modules 212*a* and 212*b*, plural pumps 214*a* and 214*b*, a pump drive motor 218 and an ink converging portion 210.

The ink branching portion 206 is a portion for splitting ink supplied from the upstream-side ink flow path 204 between plural branch flow paths 208. As the ink branching portion 206, for example, a branch tube and so on can be suitably used. Also, in the embodiment, the ink branching portion 206 splits ink supplied from the upstream-side ink flow path 204 between two branch flow paths 208.

The plural branch flow paths 208 are ink flow paths through which ink split at the ink branching portion 206 flows in parallel. In the embodiment, the plural ink flow paths 208 are ink flow paths having the same size. Moreover, the deaeration module 212*a* and the pump 214*a* are arranged on one of the two branch flow paths 208. The deaeration module 212*b* and the pump 214*b* are arranged on the other branch flow path 208.

The deaeration modules 212*a* and 212*b* are modules for deaerating gas dissolved in ink. In the embodiment, respective plural deaeration modules 212*a* and 212*b* are arranged between the ink branching portion 206 and the ink converging portion 210 in respective plural branch flow paths 208. Accordingly, the plural deaeration modules 212*a* and 212*b* are arranged in parallel in the ink flow path. The deaeration modules 212*a* and 212*b* also include exhaust ports connected to the pump for deaeration 104. By using the pump for deaeration 104 which exhausts gas, the gas (oxygen and the like) dissolved in the ink, which passing through the deaeration modules 212*a* and 212*b*, is deaerated.

Note that, the deaeration modules 212*a* and 212*b* are exchangeable parts in the embodiment. As the deaeration modules 212*a* and 212*b*, for example, general-purpose deaeration modules can be used in accordance with, for example, the necessary deaeration volume. The ability of deaeration in the deaeration modules 212*a* and 212*b* is appropriately adjusted by, for example, the exhaust volume of the pump for deaeration 104. A specific structure of the deaeration modules 212*a* and 212*b* will be explained in more detail later.

The plural pumps 214*a* and 214*b* are pumps arranged so as to correspond to the plural deaeration modules 212*a* and 212*b*. Respective pumps 214*a* and 214*b* are arranged on the downstream side of the deaeration modules 212*a* and 212*b* in respective branch flow paths 208 in series to corresponding respective deaeration modules 212*a* and 212*b*. Accordingly, the pumps 214*a* and 214*b* allow ink to flow in corresponding deaeration modules 212*a* and 212*b* in respective branch flow paths 208. In the embodiment, the pumps 214*a* and 214*b* are tube pumps (tubing pumps) sending ink by rollers bearing down the tubes, allowing ink in the previously set flow rate to flow from the upstream side to the downstream side in respective branch flow paths 208, by moving the rollers in accordance with power received from the pump drive motor 218.

The pump drive motor 218 is a motor to be an actuator for driving the rollers in the pumps 214*a* and 214*b*. As the pump drive motor 218, for example, a stepping motor can be used. When the pump drive motor 218 is thus configured, for example, the flow rate of ink allowed to flow by the pumps 214*a* and 214*b* can be appropriately controlled with high accuracy.

Also, in the embodiment, the pump drive motor 218 is arranged in common to the plural pumps 214*a* and 214*b* arranged on the plural branch flow paths 208 branched from one upstream side ink flow path 204, and the plural pumps 214*a* and 214*b* are driven by one pump drive motor 218. When applying the above structure, for example, operations of the pumps 214*a* and 214*b* can be properly synchronized with high accuracy. Specific structures of the pumps 214*a*, 214*b* and the pump drive motor 218 will be explained in more detail later.

The ink converging portion 210 is a portion of sending ink to the downstream-side ink flow path 216 by converging plural branch flow paths 208. Accordingly, the ink converging portion 210 sends ink to which the deaeration has been performed by plural deaeration modules 212*a* and 212*b* to the downstream-side ink flow path 216. As the ink converging portion 210, a branch tube and so on can be suitably used.

The downstream-side ink flow path 216 is an ink flow path on the downstream side of the deaeration portion 152, sending the ink after passing through the deaeration portion 152 to the inkjet head 12. Accordingly, the downstream-side ink flow path 216 supplies ink to which deaeration has been performed in each of the plural each-color ink supply portions 102 to the inkjet head 12.

In the embodiment, the downstream-side ink flow path 216 is a flow path having a structure including a tube of a length of 5 m or more, supplying ink to the inkjet head 12 which moves in respective X and Y directions on the pedestal portion 18. The downstream-side flow path may include a tube of, for example, 8 m or more (for example, approximately 8 m to 9 m).

As the downward-side ink flow path 216, for example, a flexible tube and the like can be used. The downward-side ink flow paths 216 sending ink from respective plural each-color ink supply portions 102 are connected to the inkjet head 12 in a bundled state, supplying ink to the inkjet head 12.

According to the embodiment, for example, ink of respective colors can be adequately deaerated in the each-color ink supply portions 102. Accordingly, printing can be adequately performed by using the ink after deaeration. Additionally, as it is not necessary to prepare ink to which deaeration is previously performed as ink to be stored in the ink tank 202, and ink can be provided at low costs.

In the deaeration portion 152 of the each-color ink supply portion 102, plural deaeration modules 212*a* and 212*b* arranged in parallel are used, thereby reducing the flow rate of ink flowing in respective deaeration modules 212*a* and 212*b*. Accordingly, for example, pressure applied on the deaeration modules 212*a* and 212*b* can be suppressed and the load on the deaeration modules 212*a* and 212*b* can be properly reduced. Moreover, a larger deaeration volume can be properly realized if necessary by using the plural deaeration modules 212*a* and 212*b* arranged in parallel.

Also in the embodiment, the following advantages can be also obtained according to the structure explained above. For example, in the branch flow paths 208 in which the respective deaeration modules 212*a* and 212*b* are arranged, the pumps 214*a* and 214*b* are connected in series to the deaeration modules 212*a* and 212*b*. Accordingly, the flow rate of ink flowing in the respective deaeration modules 212*a* and 212*b* can be properly controlled at high accuracy. Therefore, according to the embodiment, for example, occurrence of variation in the flow rate of ink can be adequately prevented in the plural deaeration modules 212*a* and 212*b* arranged in parallel. Moreover, it becomes possible to properly perform deaeration at high accuracy so as to correspond to the deaeration volume previously set by design and so on.

Also, in the embodiment, the plural pumps 214*a* and 214*b* arranged on the plural branch flow paths 208 branched from one upstream-side ink flow path 204 are driven by one pump drive motor 218. Accordingly, the operations of the plural pumps 214*a* and 214*b* are properly synchronized at high accuracy.

When it is difficult to synchronize the operation timing with respect to the plural pumps 214*a* and 214*b*, there is a danger that ink is not allowed to flow properly as the ink discharged from one branch flow path 208 flows into the other branch flow path 208. Moreover, when operations of plural pumps 214*a* and 214*b* are synchronized, in the case where the pump drive motor is individually arranged to each of the pumps 214*a* and 214*b*, the structure and control of the device may be complicated. In response to this, according to the embodiment, operations of the plural pumps 214*a* and 214*b* can be properly synchronized at high accuracy without complicating the structure and control of the device.

Also, in the embodiment, the pumps 214*a* and 214*b* are arranged on the downstream side of the deaeration modules 212*a* and 212*b* in respective branch flow paths 208. Accordingly, it is possible to properly prevent the load from being applied on the deaeration modules 212*a* and 212*b* according to the embodiment. Furthermore, the deaeration of ink can be performed more adequately according to the above.

In the branch flow paths 208, for example, in the case where the pumps 214*a* and 214*b* are arranged on the upstream side of the deaeration modules 212*a* and 212*b*, which is reverse to the structure shown in FIG. 1B, the pumps 214*a* and 214*b* keep sending a fixed amount of ink to the deaeration modules 212*a* and 212*b*. However, when ink is sent for a long distance by the downstream-side ink flow path 216 as in the embodiment, the resistance of ink flow is increased on the downstream side of the deaeration modules 212*a* and 212*b*. Accordingly, when applying the above structure, the load applied on the deaeration modules 212*a* and 212*b* sandwiched between the pumps 214*a*, 214*b* and the downstream-side ink flow path 216 may be extremely increased. As a result, there is a danger that pressure inside the deaeration modules 212*a* and 212*b* is increased and the deaeration modules 212*a* and 212*b* are damaged due to blowout.

In response to the above, as both the pumps 214*a*, 214*b* and the downstream-side ink flow path 216 are arranged on the downstream side of the deaeration modules 212*a* and 212*b* when configured as in the embodiment, excessive load is not applied on the deaeration modules 212*a* and 212*b* even when the resistance of ink flow in the downstream-side ink flow path 216 is high. Accordingly, it is properly possible to properly prevent the excessive load from being applied on the deaeration modules 212*a* and 212*b* as described above according to the embodiment. Therefore, deaeration of ink can be properly performed at high accuracy in the inkjet printer.

Subsequently, a more specific structure of the inkjet printer 10, a modification example of a structure of the inkjet printer 10 and so on will be explained below. In the deaeration portion 152 of the embodiment, for example, more (three or more) branch flow paths 208 may be provided. In this case, the deaeration module 212 and the pump 214 are arranged in each branch flow path 208 in series. The deaeration portion 152 may also have valves for opening and closing respective branch flow paths 208. When the deaeration portion 152 is thus configured, a necessary number of branch flow paths 208 can be used according to the necessary deaeration volume.

When the durability of the deaeration modules 212*a* and 212*b* can be sufficiently secured, it can be considered that, for example, the pumps 214*a* and 214*b* are arranged on the upstream side of the deaeration modules 212*a* and 212*b* in the branch flow paths 208. When applying the above structure, the deaeration can be properly performed at higher accuracy by performing deaeration of ink at positions closer to the inkjet head 12. Also in the case where air is mixed into ink from a joint in the pumps 214*a* and 214*b* in the previous stage, the air can be properly deaerated.

Here, the viscosity of ink used in the inkjet printer 10 of the present embodiment is preferably in a range of approximately 1 mPa·s to 30 mPa·s. Additionally, the temperature of ink is preferably in a range of 10° C. to 45° C. while the deaeration modules 212*a* and 212*b* are operated. It is also preferable that the temperature of ink is in a range of −20° C. to 60° C. in good order while the deaeration modules 212*a* and 212*b* are not operated. Moreover, the ink to be used is preferably an ink including color materials for recording characters and images on a plane surface, as well as a functional ink such as an organic electronics material and an ink of metal nanoparticle dispersion.

More specifically, for example, an UV ink (UV curable ink) can be used as an ink used in the inkjet printer 10. In this case, the inkjet printer 10 further includes, for example, an ultraviolet light source which generates ultraviolet light for curing the UV ink.

When the UV ink is used, the ink may be solidified unless a certain degree of oxygen is included in the ink. Accordingly, there is a danger that curing of ink proceeds from a point when deaeration is performed, if too strong deaeration is performed. Therefore, it is important to properly control the deaeration volume when using the UV ink.

As the ink used in the inkjet printer 10, for example, the ink including a low-boiling solvent component may be used. In this case, there is a danger that the solvent is lost with the deaerated gas and the viscosity of the ink is increased when performing too strong deaeration. Accordingly, it is also important to properly control the deaeration volume also in this case.

It is also preferable that plural types of ink are switched to be used according to need in the same device, and not limiting the type of ink to be used to one type in the inkjet printer 10. For example, it is preferable to use by switching between a reactive dye ink and an acid dye ink according to the need. It is also preferable to use by switching between a water-based dye ink and a water-based pigment ink, between a water-based ink and a solvent ink, between a sublimation transfer ink and the solvent ink, between transparent ink and a white ink and so on according to the need. It can be considered to perform switching, for example, between UV ink having different hardness after curing.

When plural types of ink are used as described above, in order to properly operate the inkjet printer 10 by switching the types of ink to be used, it is necessary to set the necessary deaeration volume in each ink to be used. Accordingly, it is important to properly control the deaeration volume also in this case.

In response to this, it is possible to properly change the deaeration volume by adjusting output of the pump drive motor 218 according to the embodiment. Moreover, the plural deaeration modules 212*a* and 212*b* are arranged in parallel, as well as the plural pumps 214*a* and 214*b* operated in synchronized with each other are arranged on the downstream side of the deaeration modules 212*a* and 212*b*, thereby adequately uniforming the flow rate of ink flowing in respective deaeration modules 212*a* and 212*b*. Accordingly, it is possible to properly deaerate ink at high accuracy so as to correspond to the necessary deaeration volume in each of these various types of ink according to the embodiment. It is also possible to perform printing at high accuracy by sufficiently exercising the performance of ink.

As the deaeration volume can be properly controlled at high accuracy in the embodiment, for example, a desired deaeration volume can be obtained by using general-purpose inexpensive deaeration modules without using a dedicated deaeration module corresponding to the type of ink and so on. Accordingly, it is possible to perform deaeration at high accuracy at low costs according to the embodiment.

Furthermore, the structures of the ink supply portion 20 and the each-color ink supply portion 102 according to the embodiment can be also supplied to printers other than the large-sized inkjet printer such as the flat-bed type printer. Also, in this case, the deaeration of ink can be properly performed at high accuracy so as to correspond to the type of ink to be used. It is also possible to perform the deaeration at high accuracy at low costs by using the general-purpose inexpensive deaeration modules.

When considered more generally, the structures of the ink supply portion 20 and the each-color ink supply portion 102 of the embodiment can be used in a liquid discharge device for discharging discharge liquid from a liquid discharge head, not limited to the inkjet printer which performs printing. In this case, for example, the structure of using the discharge liquid can be applied instead of using ink in the above explanation. Also, in this case, the deaeration can be properly performed to the discharge liquid at high accuracy.

Figure 2:
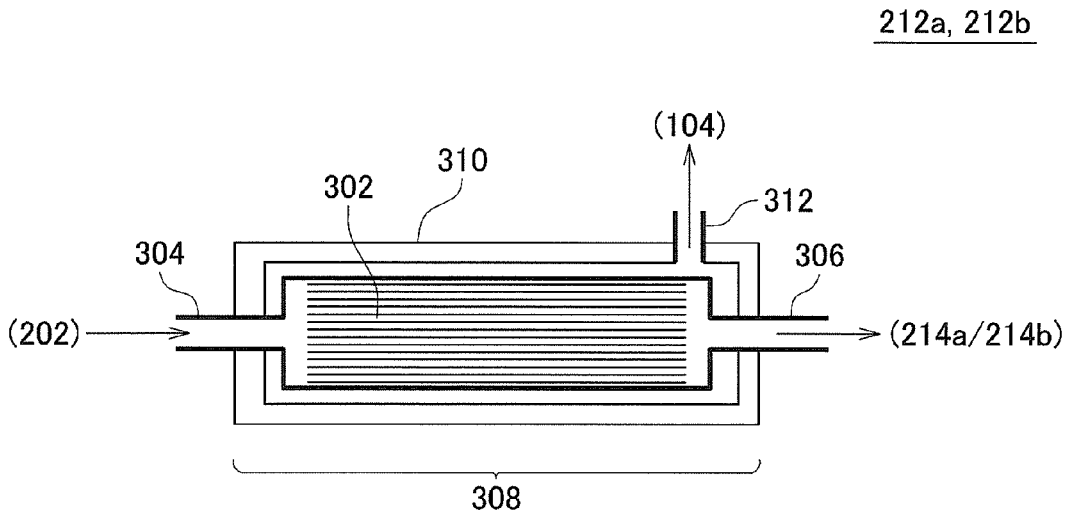
FIG. 2 is a view showing an example of a detailed structure of deaeration modules.

FIG. 2 is a view showing an example of a detailed structure of the deaeration modules 212*a* and 212*b*. In the embodiment, each of the deaeration modules 212*a* and 212*b* includes: a deaeration membrane 302, an ink introducing port 304, an ink lead-out port 306 and a deaeration chamber 308, allowing ink supplied from the ink tank 202 to pass through and sending the ink toward the pumps 214*a* and 214*b* as shown by arrows in the drawing.

The deaeration membrane 302 is a membrane made of a functional material for transmitting only gas without transmitting ink. In the embodiment, the deaeration membrane 302 is formed by, for example, a bundle of membranes formed in a tube shape, which is housed inside the deaeration chamber 308. As materials for the deaeration membrane 302, a hollow fiber membrane, a composite multiple hollow fiber membrane and so on having a proper inner diameter and a membrane thickness can be cited, and various optimum materials can be selected according to applications. For example, polymer materials such as a polyolefin polymer, a silicone-gum polymer, a polyurethane polymer and a cellulosic polymer can be used. It is preferable to determine the thickness and shape of the membrane according to conditions such as materials of ink to be used and required dissolved gas concentration in ink. Furthermore, the deaeration membrane 302 may apply a structure in which one type of membrane is used by itself as well as a multilayer structure. When the multilayer is applied, a structure formed by a combination of different types of materials may be applied.

The ink introducing port 304 is an introducing port from which ink is introduced into the deaeration chamber 308, and the ink introducing port 304 introduces the ink supplied from the ink tank 202 into the deaeration chamber 308. The ink lead-out port 306 is an ink lead-out port from which ink is led out from the deaeration chamber 308 to the outside, and the ink lead-out port 306 leads out the ink to which the deaeration has been performed by the deaeration membrane 302 toward the pump 214*a* or 214*b*.

The deaeration chamber 308 is a casing portion for housing and holding the deaeration membrane 302. In the embodiment, the deaeration chamber 308 includes: a frame body 310 and an exhaust port 312. The frame body 310 is a case for housing the deaeration membrane 302 inside. The exhaust port 312 is an opening portion connected to the pump for deaeration 104. According to the embodiment, the deaeration of ink can be properly performed by using the deaeration modules 212*a* and 212*b*.

Figure 3:
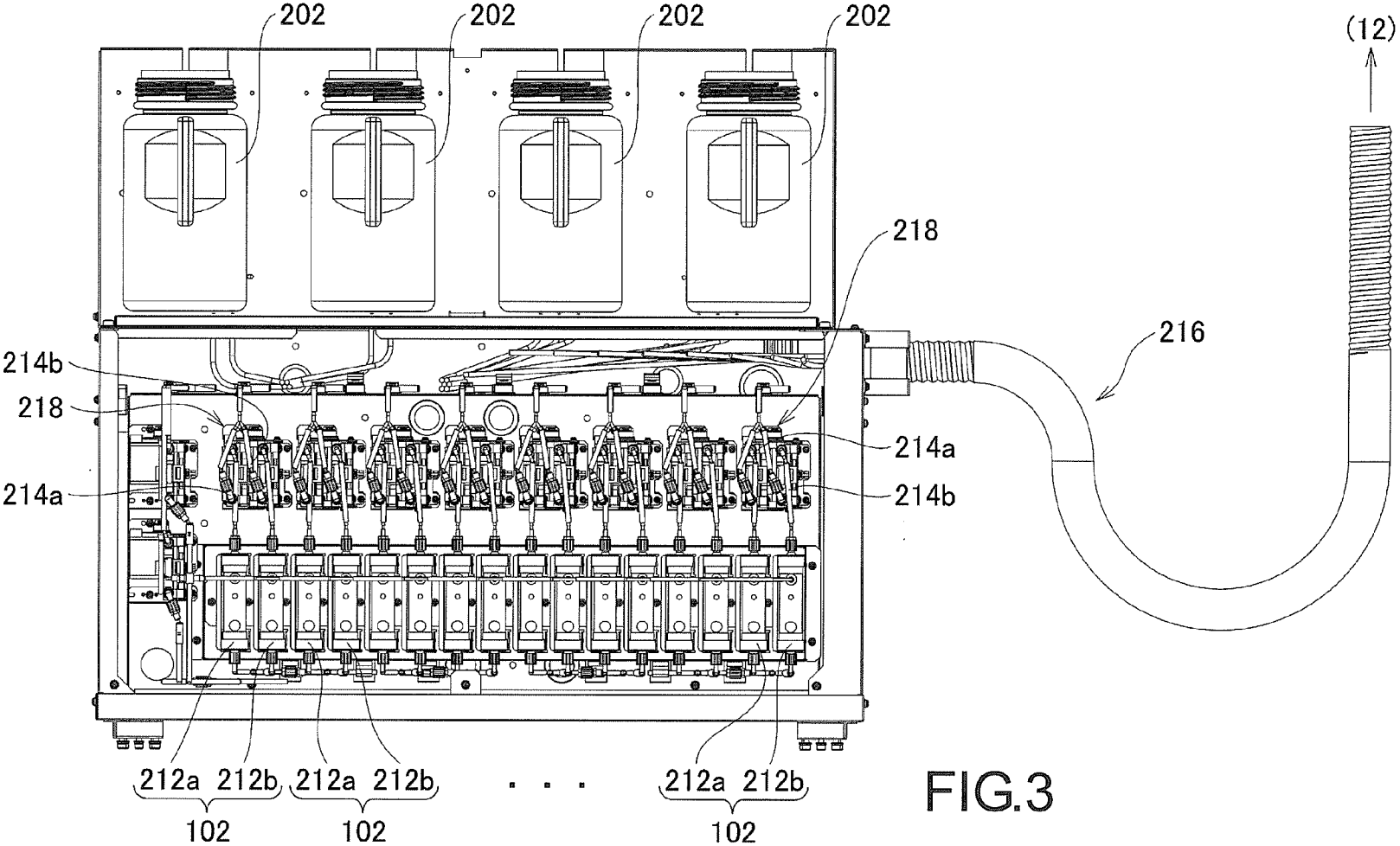
FIG. 3 is a front view of a specific structure of the ink supply portion.
Figure 4:
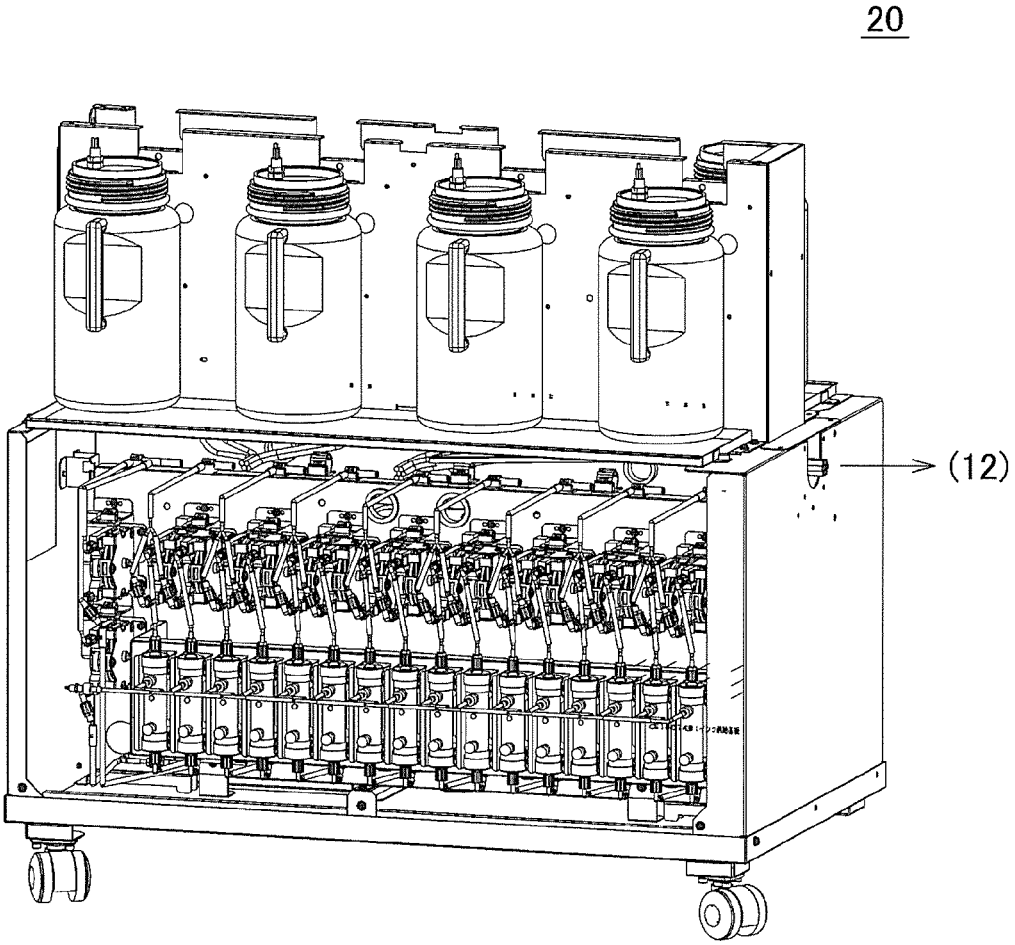
FIG. 4 is a perspective view of the specific structure of the ink supply portion.

FIG. 3 to FIGS. 5A, 5B, 5C and 5D show an example of a more specific structure of the ink supply portion 20. The specific structure shown in FIG. 3 to FIGS. 5A, 5B, 5C and 5D is the same as or similar to the structure shown in FIGS. 1A, 1B and FIG. 2. For example, components in FIG. 3 to FIGS. 5A, 5B, 5C and 5D denoted by the same reference numerals as in FIGS. 1A, 1B and so on are the same as or similar to the components shown in FIGS. 1A, 1B and FIG. 2. The components of respective portions inside the ink flow path in FIG. 3 and FIG. 4 are the same as the components shown in FIGS. 1A, 1B and so on. For convenience in drawing, only part of components is denoted by reference numerals in FIG. 3 to FIGS. 5A, 5B, 5C and 5D in the components corresponding to the components shown in FIGS. 1A, 1B and so on.

FIG. 3 is a front view of a specific structure of the ink supply portion 20. FIG. 4 is a perspective view of the specific structure of the ink supply portion 20. In the embodiment, the ink supply portion 20 can use eight ink tanks 202 at the maximum. The ink supply portion 20 includes eight each-color ink supply portions 102 so as to correspond to the number of usable ink tanks 202. The each-color ink supply portion 102 includes: two deaeration modules 212*a* and 212*b*, two pumps 214*a* and 214*b*, one pump drive motor 218 and the like in the deaeration portion 152 (refer to FIG. 1B) as explained with reference to FIG. 1B. The two deaeration modules 212*a* and 212*b* are arranged on respective branch flow paths 208 (refer to FIG. 1B) branched from the upstream-side ink flow path 204 (refer to FIG. 1B), thereby being arranged in parallel. Each of the two pumps 214*a* and 214*b* is connected to each of the deaeration modules 212*a* and 212*b* in series on the downstream side of the ink flow paths in respective branch flow paths 208. The pump drive motor 218 drives the two pumps 214*a* and 214*b*.

As shown in FIG. 3, the downstream-side ink flow path 216 sending ink from the each-color ink supply portions 102 to the inkjet head 12 is connected to the inkjet head 12 in a state of being bundled into a flexible tubular portion. According to such specific structure, the deaeration of ink can be properly performed in the embodiment.

Figure 5A:
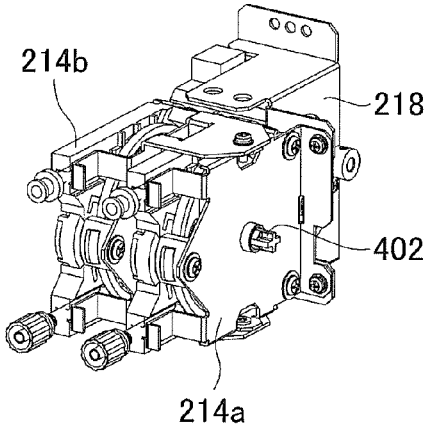
FIGS. 5A to 5D are views showing an example of specific structures of pumps and a pump drive motor.
Figure 5C:
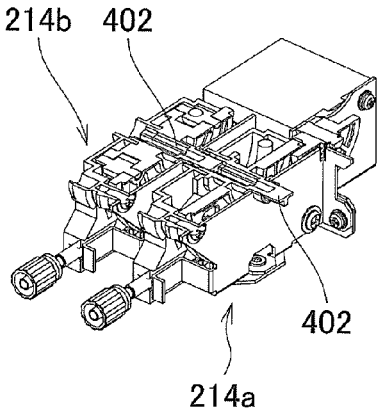
Figure 5B:
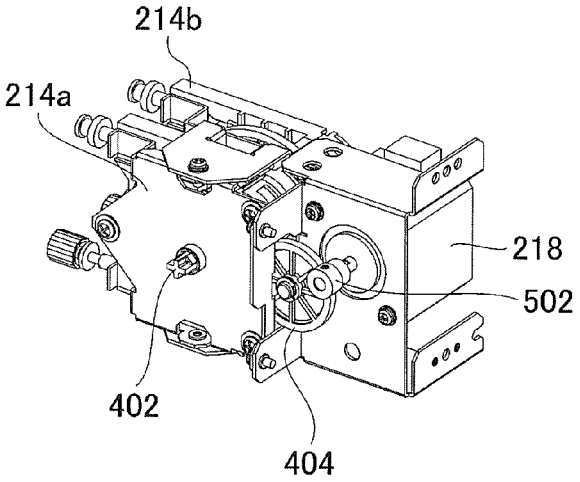
Figure 5D:
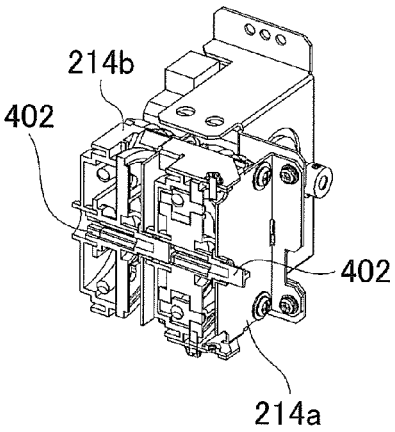

FIGS. 5A to 5D show an example of specific structures of the pumps 214*a*, 214*b* and the pump drive motor 218. FIGS. 5A and 5B are perspective views showing an example of the specific structures of the pumps 214*a*, 214*b* and the pump drive motor 218. FIGS. 5C and 5D are perspective views showing a structure for interlocking the pump 214*a* and the pump 214*b*. In FIGS. 5C and 5D, cross-sectional shapes of the pumps 214*a* and 214*b* are shown for showing an internal structure of the pumps 214*a* and 214*b*.

In the embodiment, the pump drive motor 218 is a stepping motor, transmitting power for rotating a shaft to the pump 214*a* through a gear 502. The pumps 214*a* and 214*b* are tube pumps having the same structure, each including: a tube through which ink passes by being connected into the branch flow path 208 (refer to FIG. 1B), the roller bearing down the tube and so on. Each of the pumps 214*a* and 214*b* also includes a gear 404 and a shaft 402 as components for moving the roller in accordance with driving force received from the pump drive motor 218.

The gear 404 is a gear for being engaged with a gear 502 of the pump drive motor 218. In the embodiment, only the gear 404 of the pump 214*a* in the plural pumps 214*a* and 214*b* is engaged with the gear 502 of the pump drive motor 218. Accordingly, the pump 214*a* moves the roller in accordance with the power received from the pump drive motor 218 and allows ink to flow in the tube.

The shaft 402 is a shaft rotating with the operation of the roller bearing down the tube. In the embodiment, a tip of the shaft 402 has a cross shape. At a rear end of the shaft 402, a groove corresponding to the cross shape at the tip is formed, into which the tip of another shaft 402 can be fitted. Accordingly, as shown in FIGS. 5C and 5D, when the plural pumps 214*a* and 214*b* are joined together, a tip of the shaft 402 of the pump 214*b* is inserted into the pump 214*a* and connected to the rear end of the shaft 402 of the pump 214*a*. According to the structure of the shaft 402, when one shaft 402 of any of the pumps 214*a* and 214*b* is rotated, another shaft 402 is also rotated in conjunction with one shaft 402. When the shafts 402 are rotated in the pumps 214*a* and 214*b*, the rollers are operated in accordance with the rotation.

Accordingly, when the roller of one pump 214*a* is operated by the pump drive motor 218, the shaft 402 of the pump 214*a* is rotated and the shaft 402 of the pump 214*b* is also rotated in accordance with the rotation in the embodiment. Additionally, the roller of the pump 214*b* is operated in accordance with the rotation of the shaft 402.

As described above, in the rollers of the plural pumps 214*a* and 214*b* arranged on the plural branch flow paths 208 (refer to FIG. 1B) branched from one upstream-side ink flow path 204 (refer to FIG. 1B), the roller of one pump 214*b* is configured to be operated in conjunction with the operation of the roller of the other pump 214*a*. Accordingly, the roller of one pump 214*b* can be properly operated in conjunction with the roller of the pump 214*a* by driving the roller of the other pump 214*a* by one pump drive motor 218 according to the embodiment. Accordingly, it is possible to operate the pumps 214*a* and 214*b* at high accuracy and to properly perform deaeration of ink.

The present disclosure has been explained as the above by using the embodiment, and the technical scope of the disclosure is not limited to the scope described in the above embodiment. It is obvious to those skilled in the art that various alterations or modifications may occur in the embodiment. It is obvious that embodiments in which such alterations and modifications are made may be included in the technical scope of the disclosure.

The disclosure can be suitably applied to, for example, the inkjet printer.

What is claimed is:

1. A printer, performing a printing in an inkjet system, the printer comprising:

an inkjet head, for discharging ink drops; and an ink supply portion, for supplying ink to the inkjet head, wherein the ink supply portion includes:

an ink tank, for storing ink;

a deaeration portion, for deaerating gas dissolved in ink which is in an ink flow path from the ink tank to the inkjet head;

an upstream-side ink flow path, which is an ink flow path on the upstream side of the deaeration portion, the upstream-side ink flow path sending ink supplied from the ink tank to the deaeration portion; and a downstream-side ink flow path, which is an ink flow path on the downstream side of the deaeration portion, the downstream-side ink flow path sending ink after passing through the deaeration portion to the inkjet head;

the deaeration portion includes:

an ink branching portion, for splitting ink supplied from the upstream-side ink flow path between plural branch flow paths;

plural deaeration modules, which are modules for deaerating gas dissolved in ink by allowing ink to flow into hollow fiber membranes of the deaeration modules, and in which one or more modules are arranged in respective plural branch flow paths, thereby being arranged in parallel in the ink flow path;

plural pumps, arranged so as to correspond to plural deaeration modules; and an ink converging portion, for converging the plural branch flow paths to send ink to the downstream-side ink flow path;

each of the plural deaeration modules is arranged between the ink branching portion and the ink converging portion in a corresponding branch flow path, and each of the plural pumps is arranged in series to a corresponding deaeration module in each of the branch flow paths, allowing ink to flow into the corresponding deaeration module, wherein the pumps are arranged on the downstream side of the deaeration modules in respective branch flow paths in the ink flow path, and by using the pump arranged in each of the branch flow paths, allowing ink to flow simultaneously into the deaeration modules corresponding to each of the pumps.

2. The printer according to claim 1, wherein the ink supply portion includes:

plural ink tanks;

plural deaeration portions, corresponding to the plural ink tanks;

plural upstream-side ink flow paths, corresponding to the plural deaeration portions; and plural downstream-side ink flow paths, corresponding to the plural deaeration portions;

wherein each deaeration portion includes:

the ink branching portion, the plural deaeration modules, the plural pumps, and the ink converging portion.

3. The printer according to claim 1, wherein the printer is a flat-bed type inkjet printer, and the deaeration portion is installed apart from the inkjet head at a fixed position in the printer.

4. The printer according to claim 1, wherein the ink supply portion further includes:

a downstream-side ink flow path which is an ink flow path on the downstream side of the deaeration portion, the downstream-side ink flow path sending ink after passing through the deaeration portion to the inkjet head, and the downstream-side ink flow path is an ink flow path having a tube of a length of 5 m or more.

5. The printer according to any one of claim 1, wherein the pumps are tube pumps for sending ink by rollers bearing down the tubes, the deaeration portion further includes: an actuator for driving the rollers in the pumps, and the rollers of the plural pumps arranged on the plural branch flow paths branched from one upstream-side ink flow path are driven by one actuator.

6. The printer according to claim 5, wherein the rollers of the plural pumps arranged on the plural branch flow paths branched from the upstream-side ink path are configured so that the roller of one pump is operated in conjunction with the roller of the other pump, and the actuator allows the roller of one pump to be operated in conjunction with the roller of the other pump by driving the roller of the other pump.

7. A printing method, performing the printing in the inkjet system by using the printer according to claim 1, the printing method is performed by using an ink supply device which supplies ink to the inkjet head for discharging ink drops, the printing method comprising:

storing ink by the ink tank;

deaerating gas dissolved in ink which is in the ink flow path from the ink tank to the inkjet head by the deaeration portion;

sending ink supplied from the ink tank to the deaeration portion by the upstream-side ink flow path which is the ink flow path on the upstream side of the deaeration portion; and sending ink after passing through the deaeration portion to the inkjet head by the downstream-side ink flow path which is the ink flow path on the downstream side of the deaeration portion, wherein the deaeration portion includes:

the ink branching portion, for splitting ink supplied from the upstream-side ink flow path between plural branch flow paths;

plural deaeration modules, which are modules for deaerating gas dissolved in ink by allowing ink to flow into hollow fiber membranes of the deaeration modules, and in which one or more modules are arranged in respective plural branch flow paths, thereby being arranged in parallel in the ink flow path;

plural pumps, arranged so as to correspond to plural deaeration modules; and the ink converging portion, for converging the plural branch flow paths to send ink to the downstream-side ink flow path;

each of the plural deaeration modules is arranged between the ink branching portion and the ink converging portion in a corresponding branch flow path, and each of the plural pumps is arranged in series to a corresponding deaeration module in each of the branch flow paths, allowing ink to flow into the corresponding deaeration module, wherein the pumps are arranged on the downstream side of the deaeration modules in respective branch flow paths in the ink flow path, and by using the pumps arranged in each of the ink flow path, allowing ink to flow simultaneously into the deaeration modules corresponding to each of the pumps.

8. An ink supply device, supplying ink to an inkjet head which discharges ink drops in a printer, the printer performing a printing in an inkjet system, the ink supply device comprising:

an ink tank, for storing ink;

a deaeration portion, for deaerating gas dissolved in ink which is in an ink flow path from the ink tank to the inkjet head;

an upstream-side ink flow path, which is an ink flow path on the upstream side of the deaeration portion, the upstream-side ink flow path sending ink supplied from the ink tank to the deaeration portion; and a downstream-side ink flow path, which is an ink flow path on the downstream side of the deaeration portion, the downstream-side ink flow path sending ink after passing through the deaeration portion to the inkjet head, wherein the deaeration portion includes:

an ink branching portion, for splitting ink supplied from the upstream-side ink flow path between plural branch flow paths;

plural deaeration modules, which are modules for deaerating gas dissolved in ink by allowing ink to flow into hollow fiber membranes of the deaeration modules, and in which one or more modules are arranged in respective plural branch flow paths, thereby being arranged in parallel in the ink flow path;

plural pumps, arranged so as to correspond to plural deaeration modules; and an ink converging portion, for converging the plural branch flow paths to send ink to the downstream-side ink flow path;

each of the plural deaeration modules is arranged between the ink branching portion and the ink converging portion in a corresponding branch flow path, and each of the plural pumps is arranged in series to a corresponding deaeration module in each of the branch flow paths, allowing ink to flow into the corresponding deaeration module, wherein the pumps are arranged on the downstream side of the deaeration modules in respective branch flow paths in the ink flow path, and by using the pump arranged in each of the branch flow paths, allowing ink to flow simultaneously into the deaeration modules corresponding to each of the pumps.

* * * * *